US008511477B2

(12) United States Patent
Zhu et al.

(10) Patent No.: US 8,511,477 B2
(45) Date of Patent: Aug. 20, 2013

(54) RAW COAL IMPURITY AUTOMATIC SEPARATOR

(75) Inventors: Yuwu Zhu, Zibo (CN); Lingxian Kong, Zibo (CN); Minghui Li, Zibo (CN)

(73) Assignee: Shandong Tianneng Electric Power Technology Co., Ltd., Shandong (CN)

( * ) Notice: Subject to any disclaimer, the term of this patent is extended or adjusted under 35 U.S.C. 154(b) by 0 days.

(21) Appl. No.: 13/474,241

(22) Filed: May 17, 2012

(65) Prior Publication Data

US 2012/0228200 A1 Sep. 13, 2012

Related U.S. Application Data

(63) Continuation of application No. PCT/CN2010/001797, filed on Nov. 10, 2010.

(30) Foreign Application Priority Data

Nov. 18, 2009 (CN) ..... 2009 1 0226317
Nov. 18, 2009 (CN) ..... 2009 2 0267179 U

(51) Int. Cl.
*B07B 13/00* (2006.01)

(52) U.S. Cl.
USPC ..... 209/660; 209/616

(58) Field of Classification Search
USPC ..... 209/616, 660
See application file for complete search history.

(56) References Cited

U.S. PATENT DOCUMENTS 4,484,684 A * 11/1984 Tetreault ..... 209/616
2012/0228200 A1* 9/2012 Zhu et al. ..... 209/660

FOREIGN PATENT DOCUMENTS

| | | | |
|---|---|---|---|
| CA | 2 625 914 | A1 | 9/2008 |
| CN | 2571509 | Y | 9/2003 |
| CN | 2630199 | Y | 8/2004 |
| CN | 201316720 | Y | 9/2009 |
| CN | 201596626 | U | 10/2010 |
| GB | 722624 | A | 1/1955 |

OTHER PUBLICATIONS

Notification of Comments for the First Examination issued Oct. 26, 2011 in corresponding Chinese Application No. 200910226317.6, and English translation thereof.

Notification of the Patent Right Authorization to the Invention issued Feb. 3, 2012 in corresponding Chinese Application No. 200910226317.6, and English translation thereof.

International Search Report (PCT/ISA/210) issued on Feb. 10, 2011, by the Chinese Patent Office as the International Searching Authority for International Application No. PCT/CN2010/001797.

* cited by examiner

*Primary Examiner* — Terrell Matthews
(74) *Attorney, Agent, or Firm* — Buchanan Ingersoll & Rooney PC

(57) ABSTRACT

A raw coal impurity automatic separator includes a rack and a shell; a rotating shaft set on the rack within the shell; shift teeth are arranged on the shaft; spiral-shaped scraping plates are fixed on the rack and are symmetrically arranged between the shift teeth; a slide block is arranged as a sleeve on each shift tooth; each slide block is provided with upper and lower rollers, between which the scrapping plates are set; a raw coal inlet is provided corresponding to an upper part of an inner cavity of the shell, a raw coal outlet is set on a lower part of the inner cavity; and an impurity outlet is set corresponding to an end of the scraping plates.

8 Claims, 2 Drawing Sheets

RAW COAL IMPURITY AUTOMATIC SEPARATOR

TECHNICAL FIELD

The invention relates to a raw coal impurity automatic separator, which can be used to remove impurities from granule materials used in the industries of thermal power or heat generation, coal mines, raw coal application, ports and wharf, metallurgy, building material, etc.

BACKGROUND TECHNOLOGY

In the industries of thermal power or heat generation, coal mines, raw coal application, ports and wharf, metallurgy, building material, and the like, the impurities in granule materials need to be removed. Taking thermal power generation for example, due to various reasons, raw coal, in the process of production, transportation, storing and using, is mixed with iron, wood blocks, stones, cloth, ropes, fibers, weeds and plastics, which easily cause a belt conveyor and raw coal outlet to be blocked. Especially at the sequential stage of producing powder, the impurities easily cause a milling machine to be damaged and a separator to be blocked. A smooth supply of powder cannot be guaranteed. Not only frequent cleaning costs money, but it also affects safe and stable operation of the boiler

SUMMARY

A purpose of the invention is to provide a raw coal impurities automatic separator, which can remove the foreign matters in raw coal, so as to ensure the safe supply of raw coal. The disclosure relates to a raw coal impurities automatic separator that comprises a rack and a shell, wherein the shell is internally provided with a rotating shaft set on the rack.

The rotating shaft is distributed with shift teeth and Archimedes-spiral-shaped scraping plates which are fixed on the rack and are symmetrical arranged corresponding to the shift teeth. The shift teeth are correspondingly arranged in shift tooth gaps between the scraping plates, and each shift tooth is sleeved with a slide block. The slide block is provided with upper and lower rollers, between which the scrapping plates are set. A raw coal inlet is provided corresponding to the upper part of an inner cavity of the shell, a raw coal outlet is set on the lower part thereof and an impurities outlet is set corresponding to the tail end of the curved scraping plates.

In usage, raw coal goes from coal inlet into the shell cavity, and the rotating shaft drives the shift teeth, which pick and carry the foreign matters in raw coal. The scrapping plates bring the foreign matters to the impurities outlet with the help of slide blocks. The upper and lower rollers help the slide blocks to move along the scrapping plate. A raw coal inlet is equipped with belt conveyer for direct supply of coal. An impurities outlet is fixed with impurities case to collect the foreign matters picked out.

The main parts are made by precision casting technology, and the rail, wheel rod, the pulley and the like are made of wear-resistant materials, for instance, stainless steel. Stable and reliable operation is available and less maintenance is required. Frequency control technology is used for power supply and gear speed is adjusted to meet different coal flows.

A detection assembly is set at the upper part of the raw coal outlet, such as rotary wheel and electronic probe, to detect instantly whether the raw coal outlet is blocked or not. If blocking is detected, the supply of raw coal is controlled by the use of DCS configuration and remote communication, allowing time to clean.

The invention has the advantage of simple structure and can well pick out the impurities from raw coal. This invention gets rid of the potential risk in the powder-making equipment, keep the separator from being blocked and guarantee smooth supply of powder material and safe operation of the boiler. It is widely used to remove foreign matters in granule materials in the industries of coal mines, coal application, ports and wharf, metallurgy, building material, and the like. The gap of shift teeth is adjustable to be used for granule materials of different sizes in diameter of 30-150 mm. The processing capacity is 100-3500 t/h. Multi-stage series are available and impurities separation rate reaches 95% and more.

Figure 1:
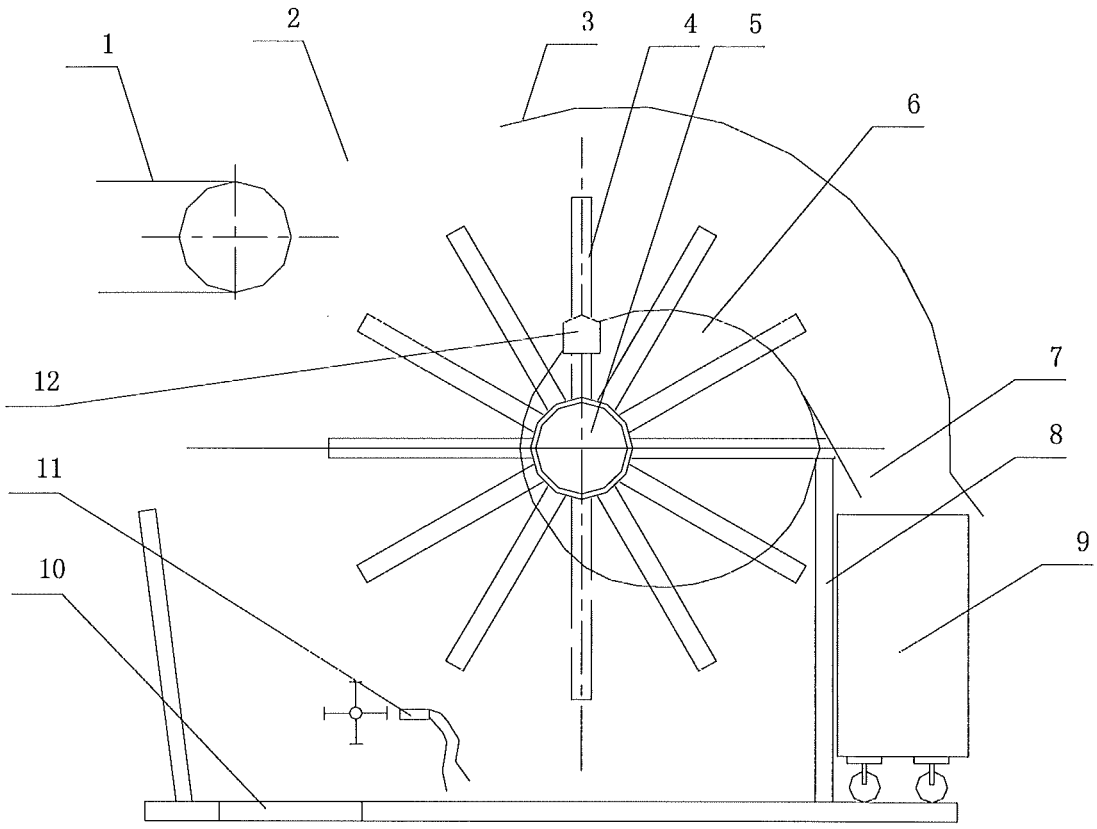
FIG. 1 is a view of an embodiment of the present invention.
Figure 2:
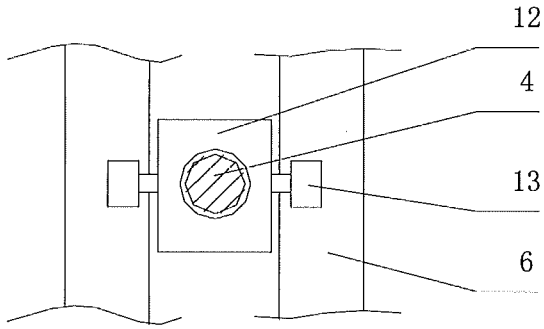
FIG. 2 is a view of an embodiment of a slide block.
Figure 3:
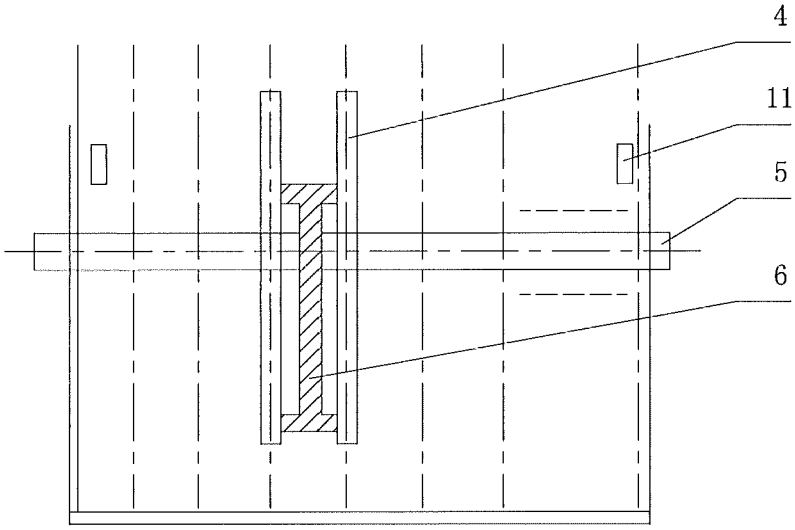
FIG. 3 is a view of an embodiment of a shift tooth gear and a scraping plate.

In the figures, 1 belt conveyer, 2 raw coal inlet, 3 shell, 4 shift teeth, 5 rotating shaft, 6 curved scrapping plate, 7 impurities outlet, 8 frame, 9 foreign matters case, 10 raw coal outlet, 11 blockage detection assembly, 12 slide block, 13 roller.

DETAILED DESCRIPTION OF A PREFERRED EMBODIMENT

As shown in drawings, the raw coal impurity automatic separator comprises a rack 8 and a shell 3, wherein the shell 3 is internally provided with a rotating shaft 5 set on the rack 8. The rotating shaft 5 is distributed with shift teeth 4 and Archimedes-spiral-shaped scraping plates 6 are fixed on the rack and are symmetrically arranged corresponding to the shift teeth. The shift teeth are correspondingly arranged in shift tooth 4 gaps between the scraping plates 6 and each shift tooth 4 is sleeved with a slide block 12. A raw coal inlet 2 is provided corresponding to the upper part of an inner cavity of the shell and a belt conveyer is set corresponding to the raw coal inlet 2 for direct supply of coal. The lower part is set as raw coal outlet and at the tail end of the corresponding scrapping plate is set at impurities outlet 7 and an impurities case 9 to collect impurities picked out.

When in use, the belt conveyor 1 delivers raw coal directly to the raw coal inlet 2 and then into the inner cavity of the shell 3. The rotating shaft 5 drives the shift teeth 4 to rotate. A slide block 12 is arranged on each shift tooth. The slide blocks 12 each include rollers 13 which ride on the periphery of the curved scrapping plates 6. As the rollers ride on the plates 6, the rollers move the slide blocks 12 along the shift teeth 4. As the slide blocks 12 move to the distal end of the teeth 4, the slide blocks pick out and carry the impurities in the raw coal off of the teeth 4. The curved scrapping plates bring the soft impurities on the shift teeth 4 to the impurities outlet 7 with the help of the slide block 12 forward movement and up-down movement along the shift teeth. In this way the soft impurities that remain on the shift teeth and scrapping plates are removed, separated and collected into the impurities case 9. The raw coal without impurities is discharged at the raw coal outlet.

A detection assembly 11 can detect instantly whether a raw coal outlet 10 is blocked or not, and this signal can be used in linkage with control system, so as to clean blocking and make operation safer and more reliable.

While an illustrative embodiment of the invention has been described herein, the present invention is not limited to the preferred embodiment described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

The invention claimed is:

1. A raw coal impurity automatic separator, comprising:

a rack and a shell;

a rotating shaft set on the rack within the shell;

shift teeth arranged on the shaft;

spiral-shaped scraping plates fixed on the rack and are symmetrically arranged between the shift teeth;

a slide block arranged as a sleeve on each shift tooth, each slide block being provided with upper and lower rollers, between which the scrapping plates are set;

a raw coal inlet provided corresponding to an upper part of an inner cavity of the shell, a raw coal outlet set on a lower part of the inner cavity; and an impurity outlet set corresponding to an end of the scraping plates.

2. The raw coal impurity automatic separator according to claim 1, wherein the shift teeth are ferromagnetic.

3. The raw coal impurity automatic separator according to claim 2, wherein the shift teeth are hollow and built in with ferromagnetic materials.

4. The raw coal impurity automatic separator according to claim 1, further comprising a belt conveyer.

5. The raw coal impurity automatic separator according to claim 1, further comprising an impurity case.

6. The raw coal impurity automatic separator according to claim 2, further comprising an impurity case.

7. The raw coal impurity automatic separator according to claim 3, further comprising an impurity case.

8. The raw coal impurity automatic separator according to claim 4, further comprising an impurity case.

* * * * *